US006118079A

United States Patent [19]

Koshino et al.

[11] Patent Number: 6,118,079

[45] Date of Patent: Sep. 12, 2000

[54] POLYMER INSULATOR HAVING A SEAL OF ALUMINUM TRIHYDRATE AND A POLYMER

[75] Inventors: Yukihiro Koshino, Tajimi; Takanori Kondou, Komaki, both of Japan

[73] Assignee: NGK Insulators, Ltd., Japan

[21] Appl. No.: 09/096,872

[22] Filed: Jun. 11, 1998

[30] Foreign Application Priority Data

Jun. 23, 1997 [JP] Japan ..... 9-166128
Apr. 20, 1998 [JP] Japan ..... 10-109292

[51] Int. Cl.[7] ..... H01B 17/06

[52] U.S. Cl. ..... 174/176; 174/137 A; 174/137 B; 174/179

[58] Field of Search ..... 174/176, 177, 174/178, 179, 189, 196, 209, 137 A, 137 B, 138 C, 141 C, 140 R, 212, 140 S

[56] References Cited

U.S. PATENT DOCUMENTS

| | | | |
|---|---|---|---|
| 2,768,264 | 10/1956 | Jones et al | 218/150 |
| 2,997,526 | 8/1961 | Kessel et al | 174/137 B |
| 3,042,743 | 7/1962 | Jones | 144/243 |
| 3,626,083 | 12/1971 | Minter et al. | 174/137 B |
| 4,001,128 | 1/1977 | Penneck | 174/137 B |
| 4,433,203 | 2/1984 | Takagi | 174/30 |
| 4,476,155 | 10/1984 | Niemi . | |
| 4,604,498 | 8/1986 | Kuhl | 174/140 S |
| 5,914,462 | 6/1999 | Fujii | 174/179 |

FOREIGN PATENT DOCUMENTS 0 617 433 9/1994 European Pat. Off. .

*Primary Examiner*—Hyung-Sub Sough
*Assistant Examiner*—Kamand Cuneo
*Attorney, Agent, or Firm*—Wall Marjama Bilinski & Burr

[57] ABSTRACT

A polymer insulator having a core member, an insulation overcoat member arranged on an outer surface of the core member, and a securing metal fitting fixed to an end portion of the core member in such a manner that the end portion is contacted with the insulation overcoat member is disclosed. The disclosed polymer insulator further includes a seal portion arranged at a boundary between the insulation overcoat member and the securing metal fitting, which is made of a sealing agent in which 80–250 parts by weight of ATH (Alumina trihydrate, $Al_2O_3.3H_2O$) is included with respect to 100 parts by weight of a polymer component. Therefore, the polymer insulator according to the invention has an improved tracking-erosion resistance performance.

5 Claims, 3 Drawing Sheets

POLYMER INSULATOR HAVING A SEAL OF ALUMINUM TRIHYDRATE AND A POLYMER

BACKGROUND OF THE INVENTION

1. Field of the Invention

The present invention relates to a polymer insulator having a core member, an insulation overcoat member arranged on an outer surface of the core member, and a securing metal fitting fixed to an end portion of the core member in such a manner that the end portion is contacted with the insulation overcoat member.

2. Description of Related Art

FIG. 2 is a cross sectional view showing one embodiment of a known polymer insulator. In the embodiment shown in FIG. 2, a polymer insulator 1 comprises an FRP rod 2 as a core member, an insulation overcoat member 3 made of rubber such as silicone rubber which is arranged on an outer surface of the FRP rod 2, and securing metal fittings 4 which are secured and fixed to both ends of the FRP rod 2. The insulation overcoat member 3 comprises a sheath portion 5 and a plurality of sheds 6. In order to produce the polymer insulator mentioned above, the insulation overcoat member 3 is molded on the FRP rod 2, and then the securing metal fittings 4 are secured and fixed to both ends of the FRP rod 2. In this case, a seal portion 7 (FIG. 3) made of a sealing agent such as rubber of silicone system is arranged at a boundary between the insulation overcoat member 3 and the securing metal fittings 4, which is exposed to an external atmosphere, so as to prevent an inclusion of water or the like through the boundary.

During a normal field test, the known polymer insulator having the construction mentioned above shows no problem on tracking-erosion properties of the insulation overcoat member 3 and the seal portion 7. However, if the known polymer insulator is used under a severe fouling condition, or, if the known polymer insulator is subjected to an acceleration damage test, there is a case such that an erosion occurs at the seal portion 7. Severe fouling conditions as know in the art include coastal areas (fog, salt), deserts (dust), and so forth. Therefore, in order to improve a reliability of the polymer insulator, it is necessary to improve tracking-erosion resistant properties much more.

Moreover, the seal portion 7 is arranged at both ends of the polymer insulator 1, to which a high electric field is liable to be applied. Therefore, as shown in FIG. 3, corona or dry-band-arc is liable to be generated at the seal portion 7, especially if the polymer insulator 1 is used under the severe fouling condition. Owing to this, in the seal portion 7, it is necessary to have excellent tracking-erosion resistant properties in addition to sealing properties which are same as those of the known polymer insulator.

SUMMARY OF THE INVENTION

It is an object of the present invention to eliminate the drawbacks mentioned above and to provide a polymer insulator which can improve tracking-erosion resistant properties remarkably by improving a seal portion.

According to the invention, a polymer insulator having a core member, an insulation overcoat member arranged on an outer surface of the core member, and a securing metal fitting fixed to an end portion of the core member in such a manner that the end portion is contacted with the insulation overcoat member, comprises: a seal portion arranged at a boundary between the insulation overcoat member and the securing metal fitting, the seal portion being made of a sealing agent in which 80–250 parts by weight of ATH (Alumina Trihydrate, $Al_2O_3.3H_2O$) is included with respect to 100 parts by weight of a polymer component.

The present invention is achieved on the basis of the following finding obtained by various examinations. That is to say, in order to improve tracking-erosion resistant properties, it is effective to use a sealing agent, in which a predetermined amount of ATH preferably having a predetermined particle size and preferably applying a predetermined surface finishing is included, for the seal portion arranged between the insulation overcoat member and the securing metal fitting.

DESCRIPTION OF THE PREFERRED EMBODIMENT

Figure 1:
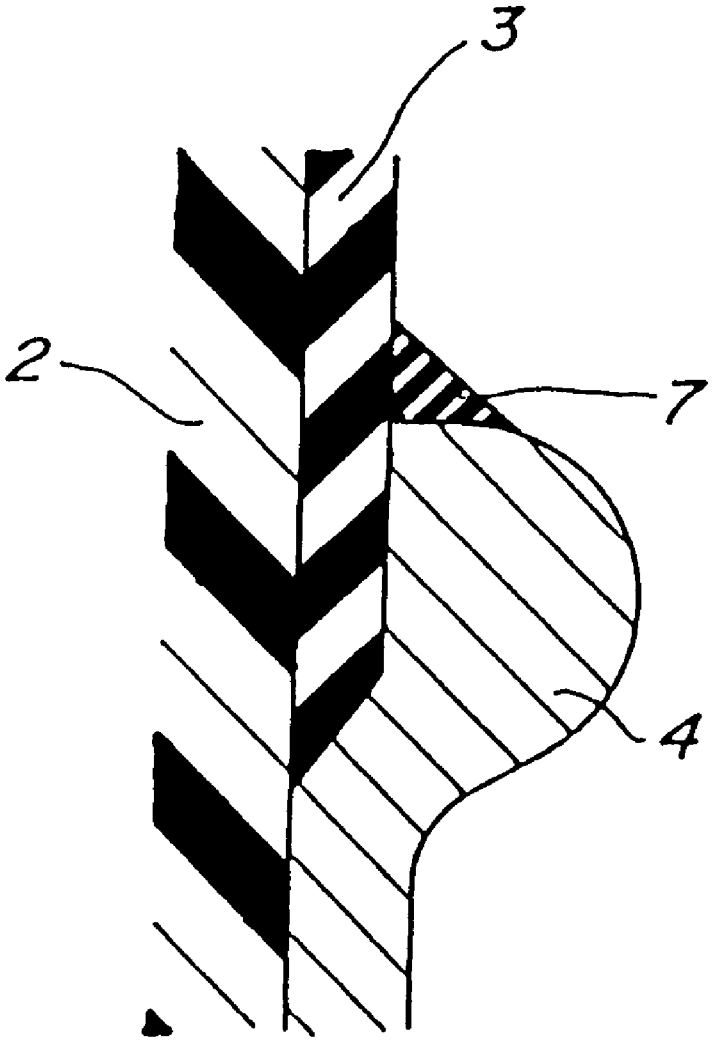
FIG. 1 is a cross sectional view showing an enlarged main portion of a polymer insulator according to the invention.
Figure 2:
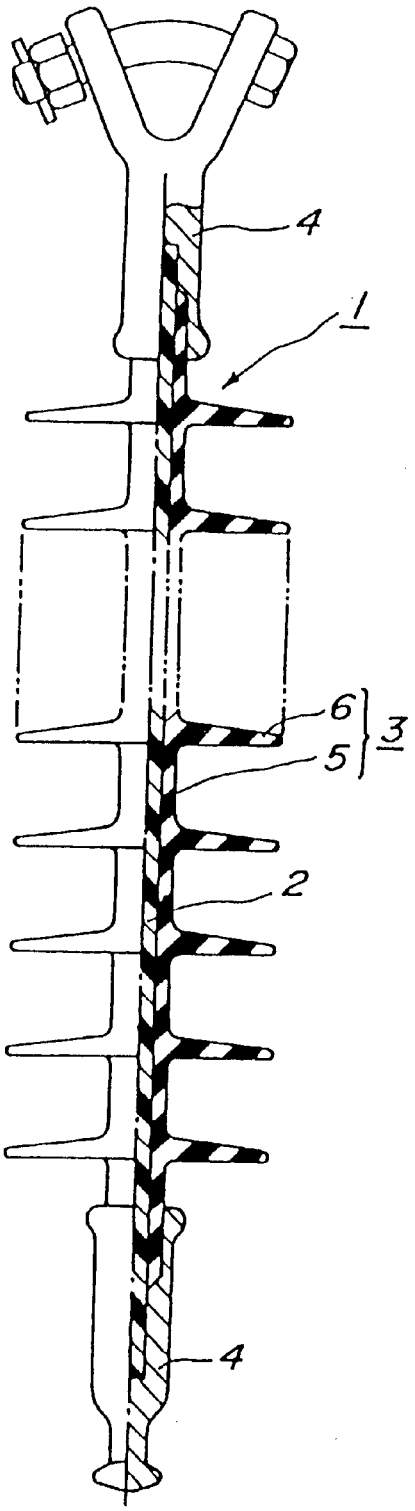
FIG 2 PRIOR ART
FIG. 2 is a cross sectional view illustrating one embodiment of a known polymer insulator.
Figure 3:
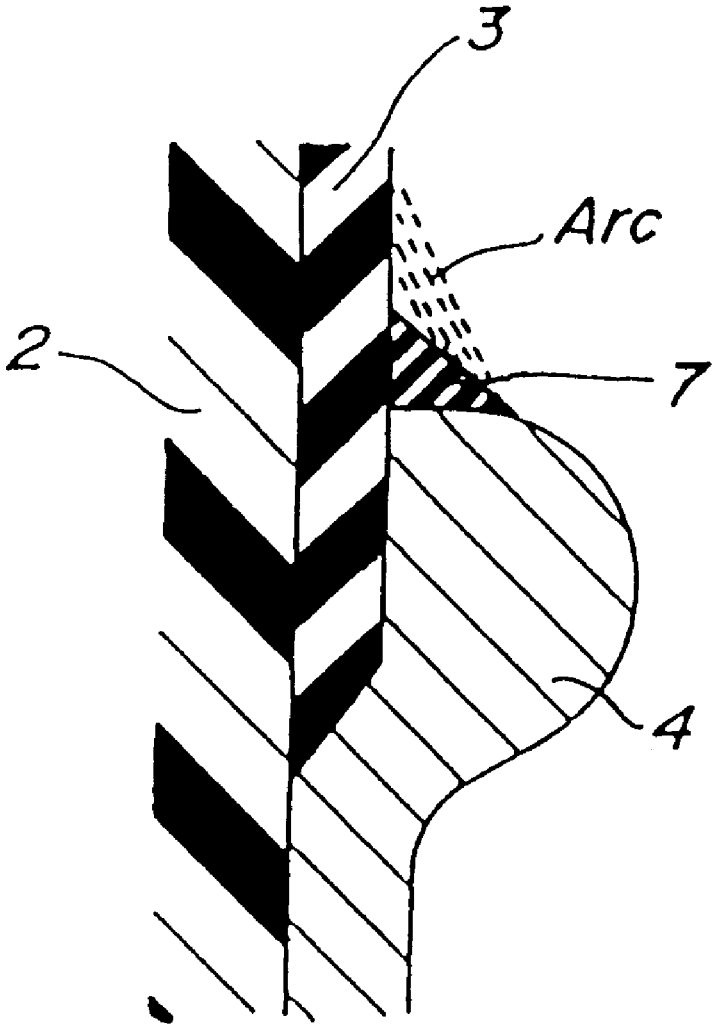
FIG 3 PRIOR ART
FIG. 3 is a cross sectional view for explaining an arc generation in the known polymer insulator.

FIG. 1 is a cross sectional view showing an enlarged main portion of a polymer insulator according to the invention. The polymer insulator according to the invention shown in FIG. 1 has fundamentally the same construction as that of the known polymer insulator shown in FIG. 2. Therefore, in the embodiment shown in FIG. 1, reference numerals similar to those of FIG. 2 are denoted by the same reference numerals as those of FIG. 2, and the explanations thereof are omitted here. In the polymer insulator according to the invention shown in FIG. 1, the feature is that a seal portion 7 made of a sealing agent, in which 80–250 parts by weight of ATH is included with respect to 100 parts by weight of a polymer component, is arranged at a boundary between the insulation overcoat member 3 and the securing metal fitting 4, which is exposed to an external atmosphere.

Here, a term "ATH" means alumina trihydrate ($Al_2O_3.H_2O$). Normally, ATH exists in a form of $Al(OH)_3$. If a heat is applied, ATH changes in a form of $Al_2O_3.H_2O$. That is, the following reaction occurs by heating: $2Al(OH)_3 \rightarrow Al_2O_3.3H_2O$). In this case, water is generated, and thus an applied heat is absorbed as a heat of evaporation of water. Therefore, it is known that, if a rubber includes ATH, it is possible to prevent heat damage of the rubber including ATH.

As a polymer component constituting the seal agent of the seal portion 7, all polymer components of silicone system can be used, and its curing type is not limited. Among them, it is preferred to use poly-dimethyl-siloxane. Moreover, a particle size of ATH included in the sealing agent of the seal portion 7 is not particularly limited from a standpoint of improving tracking-erosion resistant properties. However, a particle size of ATH is preferably limited to 3 $\mu$m or more, more preferably 8 $\mu$m or more but less than 50 $\mu$m from view points of acid resistant properties, sealing properties and water absorbing properties as clearly understood from the following examples. In addition, an upper limitation of a particle size of ATH is preferably 50 $\mu$m. If a particle size of ATH is not less than 50 $\mu$m, the sealing agent is not uniformly mixed and thus the seal portion 7 made of such a sealing agent has not a sufficient strength.

Hereinafter, actual examples will be explained.

EXPERIMENT

Sealing agents according to examples of present invention 1–9, comparative examples 1–2, and a known example were prepared by setting conditions of ATH amount, ATH particle size, ATH surface finishing, and curing type as shown in the following Table 1. In Table 1, poly-dimethyl-siloxane was used as the polymer component. Moreover, an amount of ATH indicated parts by weight of ATH with respect to 100 parts by weight of poly-dimethyl-siloxane. ATH surface finishing was effected by using silane coupling agent. Then, tracking-erosion resistant properties, acid resistant properties, and water absorbing properties of the thus prepared sealing agents were investigated, and also sealing properties of the polymer insulator using the thus prepared sealing agents for the seal portion was investigated. Hereinafter, the results of the investigations mentioned above were explained in this order.

TABLE 1

| Name of sealing agent | Amount of ATH (parts by weight) | Particle size of ATH (μm) | Surface finishing of ATH | Curing type |
|---|---|---|---|---|
| Known example | 0 | — | — | Condensation |
| Comparative example 1 | 50 | 1 | Effect | Condensation |
| Example of present invention 1 | 80 | 3 | Effect | Condensation |
| Example of present invention 2 | 100 | 1 | Non-effect | Condensation |
| Example of present invention 3 | 100 | 3 | Non-effect | Condensation |
| Example of present invention 4 | 100 | 3 | Effect | Condensation |
| Example of present invention 5 | 100 | 8 | Effect | Condensation |
| Example of present invention 6 | 150 | 1 | Effect | Condensation |
| Example of present invention 7 | 150 | 8 | Effect | Condensation |
| Example of present invention 8 | 150 | 8 | Effect | Addition |
| Example of present invention 9 | 200 | 8 | Effect | Condensation |
| Example of present invention 10 | 250 | 8 | Effect | Condensation |
| Comparative example 2 | 300 | 8 | Effect | Condensation |

(1) As to tracking-erosion resistant properties:

A tracking-erosion resistant property test was performed as follows. At first, specimens of the sealing agents shown in Table 1 were prepared on the basis of EEC 587 test method. Then, a tracking test voltage of 4.5 kV was applied constantly to the thus prepared specimens, and it was confirmed whether or not the specimen achieved a standard of 6 hours according to IEC 587 test method in which the specimen endured for 6 hours under such a voltage applying condition. For the specimens which did not achieve the standard of 6 hours, a time duration until a stop of the tracking-erosion resistant test was measured. The results were shown in the following Table 2.

From the results shown in Table 2, it is understood that all the specimens according to the examples of present invention 1–10 in which 80 parts by weight or more of ATH is included in the sealing agent achieve the standard of 6 hours, while the specimen according to the known example in a which no ATH is included in the sealing agent endures only for about 2 hours and the specimen according to the comparative example 1 in which 50 parts by weight of ATH is included in the sealing agent endures only for 3 hours.

TABLE 2

| Name of sealing agent | Time duration until stop of tracking-erosion resistant test based on IEC587 (hr) |
|---|---|
| Known example | 2.0 |
| Comparative example 1 | 3.0 |
| Example of present invention 1 | >6 |
| Example of present invention 2 | >6 |
| Example of present invention 3 | >6 |
| Example of present invention 4 | >6 |
| Example of present invention 5 | >6 |
| Example of present invention 6 | >6 |
| Example of present invention 7 | >6 |
| Example of present invention 8 | >6 |
| Example of present invention 9 | >6 |
| Example of present invention 10 | >6 |
| Comparative example 2 | >6 |

(2) As to acid resistant properties:

An acid resistant property test was performed in such a manner that the sealing agents each having a constant amount according to the examples of present invention 1–10, the comparative examples 1–2, and the known example were immersed into nitric acid solution having a concentration of 1 normal for 100 hours and weight decrease rate of the sealing agents were measured. The results were shown in the following Table 3.

Normally, when particles other than the polymer component are existent in the sealing agent, the weight decrease becomes larger after the acid resistant property test mentioned above. Therefore, it is estimated that the sealing agent has no problem if it has the same weight decrease rate as that of the known example. From the results shown in Table 3, it is understood that the examples of present invention 2 and 3 have a large weight decrease rate. This is because ATH used in the examples of present invention 2 and 3 is not subjected to the surface finishing and thus ATH is eluted. Moreover, it is understood that, if use is made of ATH to which the surface finishing is effected, the specimen has the same weight decrease rate as that of the known example and indicates an excellent acid resistant property.

TABLE 3

| Name of sealing agent | Weight decrease rate after acid immersion (%) |
|---|---|
| Known example | 5 |
| Comparative example 1 | 5 |
| Example of present invention 1 | 5 |
| Example of present invention 2 | 30 |
| Example of present invention 3 | 25 |
| Example of present invention 4 | 5 |
| Example of present invention 5 | 5 |
| Example of present invention 6 | 5 |
| Example of present invention 7 | 5 |
| Example of present invention 8 | 5 |
| Example of present invention 9 | 7 |
| Example of present invention 10 | 8 |
| Comparative example 2 | 10 |

(3) As to water absorbing property:

A water absorbing property test was performed in such a manner that the sealing agents according to the examples of present invention 1–10, the comparative examples 1–2, and the known examples were immersed in an ion-exchanged water and water absorbing properties were judged on the basis of the weight increase rate and a variation of volume resistivity of the sealing agent. In addition, for reference, the same water absorbing property test was performed for a silicone rubber constituting the insulation overcoat member. The results were shown in the following Table 4.

From the results shown in Table 4, it is understood that the examples of present invention 2 and 3 have a large water absorbing amount. This is because ATH used in the examples of present invention 2 and 3 is not subjected to the surface finishing. Moreover, it is understood that the examples of present invention 2 and 3 have a large reduction rate of volume resistivity after water absorbing. This is also because ATH is not subjected to the surface finishing and thus a conduction path is liable to be generated after water absorbing. If such a sealing agent is used for an actual product, a performance of the seal portion becomes inferior as compared with a rubber constituting the insulation overcoat member. Therefore, an arc generation due to electric discharge is concentrated on the seal portion, and thus an erosion of the seal portion is liable to be generated. Accordingly, it is preferred to use ATH to which the surface finishing using silane coupling agent is effected. Moreover, in the case that the surface finished ATH is used, if an amount of ATH is increased in excess as shown in the comparative example 2, a water absorbing amount is increased and a volume resistivity us decreased as compared with that of rubber constituting the insulation overcoat member. Therefore, it is necessary to set an amount of ATH in the sealing agent up to 250 parts by weight with respect to 100 parts by weight of the polymer component.

TABLE 4

| Name of sealing agent | Weight increase rate after ion-exchanged water immersion for 300 hours (%) | Variation of volume resistivity upper column: before immersion lower column: after immersion (Ω · cm) |
|---|---|---|
| Known example | 0.1 | $1 \times 10^{15}$<br>$1 \times 10^{14}$ |
| Comparative example 1 | 0.2 | $1 \times 10^{15}$<br>$1 \times 10^{14}$ |
| Example of present invention 1 | 0.3 | $5 \times 10^{14}$<br>$1 \times 10^{14}$ |
| Example of present invention 2 | 0.9 | $1 \times 10^{14}$<br>$1 \times 10^{9}$ |
| Example of present invention 3 | 0.8 | $1 \times 10^{14}$<br>$1 \times 10^{10}$ |
| Example of present invention 4 | 0.3 | $5 \times 10^{14}$<br>$1 \times 10^{14}$ |
| Example of present invention 5 | 0.3 | $5 \times 10^{14}$<br>$1 \times 10^{14}$ |
| Example of present invention 6 | 0.3 | $5 \times 10^{14}$<br>$1 \times 10^{14}$ |
| Example of present invention 7 | 0.3 | $5 \times 10^{14}$<br>$1 \times 10^{14}$ |
| Example of present invention 8 | 0.3 | $5 \times 10^{14}$<br>$1 \times 10^{14}$ |
| Example of present invention 9 | 0.4 | $1 \times 10^{14}$<br>$1 \times 10^{13}$ |
| Example of present invention 10 | 0.6 | $5 \times 10^{13}$<br>$1 \times 10^{12}$ |
| Comparative example 2 | 0.6 | $1 \times 10^{13}$<br>$5 \times 12^{11}$ |
| Rubber of overcoat member | 0.3 | $5 \times 10^{14}$<br>$1 \times 10^{14}$ |

(4) As to sealing properties:

A sealing property test was performed as follows on the basis of IEC 1109 test method. At first, polymer insulators, in which sealing agents according to the examples of present invention 1–10, the comparative examples 1–2, and the known example were used for the exposed seal portion between the insulation overcoat member and the securing metal fitting, were prepared. Then, the thus prepared polymer insulator was boiled in an NaCl aqueous solution having a concentration of 0.1% for 100 hours and then immersed into a fuchsine solution. After that, sealing properties were judged on the basis of whether or not dyes were intruded into an inside of the securing metal fitting. The results were shown in the following Table 5.

Normally, the sealing property is thought to be better if such an intrusion of dyes is not detected. From the results shown in Table 5, it is understood that the example of present invention 2 shows an intrusion of dyes. The reasons are as follows. That is, since ATH used in the example of present invention 2 has a small particle size such as 1 gm and is not subjected to the surface finishing, an elongation of the seal portion is small and the seal portion does not endure such a boiling stress.

Moreover, the examples of present invention 3 and 4 use ATH having a particle size of 3 μm. In the example of present invention 3 in which ATH is not subjected to the surface finishing, the sealing property is a permissible lower level. However, in the example of present invention 4 in which ATH is subjected to the surface finishing, since affinity between ATH and rubber is improved and thus an elongation and an adhesion strength of the seal portion are also improved, the seal portion shows a sufficient sealing property. Further, in the example of present invention 6 in which 150 parts by weight of ATH having a particle size of 1 μm, since ATH is subjected to the surface finishing, its sealing property barely maintains a permissible lower level. Furthermore, in the case that ATH having a particle size of 8 μm is used as shown in the examples of present invention 5, 7–10, a sufficient elongation of the seal portion can be achieved if an amount of ATH is large, and thus a sufficient sealing property can be obtained. Contrary to this, as shown in the comparative example 2 in which ATH having the same particle size of 8 μm is used, if 300 parts by weight of ATH is added, an amount of rubber becomes too small, and thus a sufficient elongation cannot be achieved, thereby decreasing its sealing property.

TABLE 5

| Name of sealing agent | Dye intrusion into metal fitting |
|---|---|
| Known example | no-intrusion |
| Comparative example 1 | no-intrusion |
| Example of present invention 1 | no-intrusion |
| Example of present invention 2 | intrusion |
| Example of present invention 3 | a little intrusion |
| Example of present invention 4 | no-intrusion |
| Example of present invention 5 | no-intrusion |
| Example of present invention 6 | a little intrusion |
| Example of present invention 7 | no-intrusion |
| Example of present invention 8 | no-intrusion |
| Example of present invention 9 | no-intrusion |
| Example of present invention 10 | no-intrusion |
| Comparative example 2 | intrusion |

(5) Summary of the results:

The following Table 6 summarizes the tracking-erosion resistant properties, the acid resistant properties, and the water absorbing properties of the sealing agents, and also the sealing properties of the polymer insulator using the sealing agents for the seal portion. From the results shown in Table 6, it is understood that it is necessary to use a sealing agent in which 80–250 parts by weight of ATH is included with respect to 100 parts by weight of the polymer component, if mainly taking into consideration of the tracking-erosion resistant properties. In addition, it is understood that it is preferred to use ATH having a particle size of 3 μm or more, more preferably about 8 μm, but less than 50 μm, and that it is preferred to use ATH to which the surface finishing using silane coupling agents is performed, if taking into consideration of the properties other than the tracking-erosion resistant properties for reference.

TABLE 6

| Name of sealing agent | Amount of ATH (parts by weight) | Particle size of ATH (μm) | Surface finishing of ATH | Tracking-erosion resistant | Acid resistance | Sealing performance | Water absorption | Curing type |
|---|---|---|---|---|---|---|---|---|
| Known example | 0 | — | — | Δ | ○ | ◎ | ○ | Condensation |
| Comparative example 1 | 50 | 1 | Effect | Δ | ○ | ○ | ○ | Condensation |
| Example of present invention 1 | 80 | 3 | Effect | ◎ | ○ | ○ | ○ | Condensation |
| Example of present invention 2 | 100 | 1 | Non-effect | ◎ | X | X | X | Condensation |
| Example of present invention 3 | 100 | 3 | Non-effect | ◎ | X | Δ | X | Condensation |
| Example of present invention 4 | 100 | 3 | Effect | ◎ | ○ | ○ | ○ | Condensation |
| Example of present invention 5 | 100 | 8 | Effect | ◎ | ○ | ◎ | ○ | Condensation |
| Example of present invention 6 | 150 | 1 | Effect | ◎ | ○ | Δ | ○ | Condensation |
| Example of present invention 7 | 150 | 8 | Effect | ◎ | ○ | ◎ | ○ | Condensation |
| Example of present invention 8 | 150 | 8 | Effect | ◎ | ○ | ○ | ○ | Addition |
| Example of present invention 9 | 200 | 8 | Effect | ◎ | ○ | ◎ | Δ | Condensation |
| Example of present invention 10 | 250 | 8 | Effect | ◎ | ○ | ○ | Δ | Condensation |
| Comparative example 2 | 300 | 8 | Effect | ◎ | Δ | X | X | Condensation |

Legend:
◎ is Excellent
○ is Good
Δ is Acceptable
X is No Good

As clearly understood from the above explanations, according to the invention, the sealing agent, in which 80–250 parts by weight of ATH having preferably a predetermined particle size, to which a predetermined surface finishing is preferably performed, is used for the seal portion arranged at a boundary between the insulation overcoat member and the securing metal fitting of the polymer insulator, which is exposed to an external atmosphere. Therefore, the polymer insulator according to the invention has an improved tracking-erosion resistant property.

What is claimed is:

1. A polymer insulator having a core member, an insulation overcoat member arranged on an outer surface of said core member, and a securing metal fitting fixed to an end portion of said core member in such a manner that said end portion is contacted with said insulation overcoat member, said polymer insulator further comprising a seal portion arranged at a boundary between said insulation overcoat member and said securing metal fitting, said seal portion being made of a sealing agent having ATH (Alumina trihydrate, $Al_2O_3.3H_2O$) and a polymer component and consisting essentially of 80–250 parts by weight of said ATH for every 100 parts by weight of said polymer component.

2. The polymer insulator according to claim 1, wherein said polymer component is poly-dimethyl-siloxane.

3. The polymer insulator according to claim 1, wherein an average particle size of said ATH is 3 μm or more.

4. The polymer insulator according to claim 1, wherein a surface of substantially all particles of said ATH has a finish layer containing silane coupling agents.

5. A polymer insulator, comprising:

a core member;

an insulation overcoat member arranged on an outer surface of said core member;

a securing metal fitting fixed to an end portion of said core member in such a manner that said end portion is contacted with said insulation overcoat member;

a seal portion arranged at a boundary between said insulation overcoat member and said securing metal fitting; and said seal portion being made of a sealing agent having ATH (Alumina trihydrate, $Al_2O_3.3H_2O$) and a polymer component and having 80–250 parts by weight of said ATH for every 100 parts by weight of said polymer component;

wherein a surface of substantially all particles of said ATH has a finish layer containing silane coupling agents.

* * * * *